United States Patent [19]

Mehrabian et al.

[11] 3,951,651

[45] Apr. 20, 1976

[54] METAL COMPOSITION AND METHODS FOR PREPARING LIQUID-SOLID ALLOY METAL COMPOSITIONS AND FOR CASTING THE METAL COMPOSITIONS

[75] Inventors: Robert Mehrabian, Arlington; Merton C. Flemings, Cambridge, both of Mass.

[73] Assignee: Massachusetts Institute of Technology, Cambridge, Mass.

[22] Filed: July 17, 1973

[21] Appl. No.: 379,990

Related U.S. Application Data

[63] Continuation-in-part of Ser. No. 278,457, Aug. 7, 1972, abandoned.

[52] U.S. Cl. ..... 75/135; 75/10 R; 75/65 R

[51] Int. Cl.[2] ..... C22C 1/02; C22B 4/00

[58] Field of Search ..... 75/10, 65, 20 F, 129, 75/130.5, 135

[56] References Cited

UNITED STATES PATENTS

| | | | |
|---|---|---|---|
| 2,793,949 | 5/1957 | Imich | 75/135 |
| 3,189,444 | 6/1965 | Olds | 75/148 |
| 3,300,296 | 1/1967 | Hardy | 75/20 |
| 3,620,686 | 11/1971 | Pfann | 75/1.6 |

*Primary Examiner*—Peter D. Rosenberg
*Attorney, Agent, or Firm*—Arthur A. Smith, Jr.; Robert Shaw; Robert J. Horn, Jr.

[57] ABSTRACT

This invention provides a composite composition comprising a metallic matrix having a concentration of third phase solid particles homogeneously dispersed throughout the metallic matrix. The metallic matrix can be liquid, solid or partially solid and can have (a) a dendritic structure or (b) up to 65 weight percent of a structure comprising degenerate dendritic or nodular primary discrete solid particles suspended in a secondary phase having a lower melting point than the primary particles which secondary phase can be solid or liquid. The third phase particles can be metallic, non-metallic or a combination metallic-nonmetallic compositions and have a surface composition which is not wet by the metallic matrix when the matrix is a liquid.

15 Claims, 10 Drawing Figures

METAL COMPOSITION AND METHODS FOR PREPARING LIQUID-SOLID ALLOY METAL COMPOSITIONS AND FOR CASTING THE METAL COMPOSITIONS

The invention herein described was made in the course of work performed under Contract No. DAHC 04-70-C-0063 with the Department of the Army.

This application is a continuation-in-part of application Ser. No. 278,457, filed Aug. 7, 1972, and now abandoned.

This invention relates to a composite composition of metallic alloy matrixes containing third phase metallic, nonmetallic, or combination metallic-nonmetallic solid particles, to a method for preparing the composition and to a method for casting the composition.

At the present time solid particles are added to metal alloy compositions to provide desirable characteristics to the solidified product obtained from the composite composition such as hardness or strength characteristics. For example, particles which are softer than the metal alloy composition are added thereto to improve its use as a bearing while harder particles are added to the metal alloy composition to extend its life under conditions where extreme friction forces are encountered. Presently, this particle addition is conducted when the metal alloy composition is in the liquid state prior to forming a casting therefrom or powders of the desired constituents are mixed together and subsequently sintered. When adding particles to a melt, only a small amount of the particles, generally about 3 weight percent, can be added since they generally are rejected by the metal alloy composition and float to the surface or sink to the bottom thereof. It is believed that the major cause for this rejection is because the particles are not wetted by the metal alloy and therefore no intimate contact can be attained. Thus, the degree to which the characteristics of the original metal alloy composition can be changed is unduly limited.

It has been proposed to coat the particles to be added with a material which is wetted by the molten metal alloy or to add to the molten metal alloy a material which wets the added particles. For example it has been proposed to coat graphite particles with nickel which are then introduced into an aluminum alloy melt with the view of increasing the proportion of the particles in the melt. Unfortunately, even with vigorous agitation to attain a homogeneous particle dispersion within the melt, it has been possible to add only 3% of the graphite particles and furthermore the graphite particles are distributed nonhomogeneously within the metal composition.

Also, it has been proposed to add liquid or solid particles which are heavier than the melt by freezing the metal composition from its bottom surface so that dendritic networks are grown from the bottom towards the top of the melt and the heavier solid of liquid added to the top of the melt is reatined by the dendritic structures at a vertically intermediate layer or layers within the metal alloy composition after it is totally solidified. This process is generally undesirable since the distribution of the added material within the metal alloy composition is very nonhomogeneous and the characteristics of the resultant solidified composite composition varies greatly as a function of metal thickness.

In powder metallurgy wherein a powdered composition is sintered, it is possible to obtain a metal alloy composition containing a relatively high concentration of solid particles dispersed within a metal or metal alloy. However, the process is undesirable for a variety of reasons including high cost, particularly when it is desired to obtain articles having dimensions within close tolerances. Furthermore, sintered articles have low ductility and low tensile, and impact strengths which are a direct result of pores in the article and which is generally unavoidable in powder metallurgy compacts. Articles formed by powder metallurgy have a grain structure wherein the grains have an oxide film. The spacing between oxide films is of the same order as the size of the powdered particles initially employed. This spacing can be harmful to the physical properties of the sintered material by rendering it more brittle and hindering machineability.

The present invention provides a metal-metal or metal-nonmetal composite composition comprising a metal or metal alloy matrix containing third phase solid particles homogeneously distributed within the matrix, having a composition different from the metal or metal alloy and having a surface composition which is not wet by the metal alloy matrix when the matrix is a liquid. The third phase particles are present in concentrations up to about 65 weight percent. The metal or metal alloy can be liquid, solid or partially solid and when solid or partially solid can have (a) a dendritic structure or (b) up to 65 weight percent of a structure comprising degenerate dendritic or nodular primary discrete solid particles suspended in a secondary phase having a lower melting point than the primary particles which secondary phase can be solid or liquid. These compositions are formed by heating a metallic composition to a temperature at which most or all of the metallic composition is in a liquid state, and vigorously agitating the composition to convert any solid particles therein to degenerate dendrites or nodules having a generally spheroidal shape. The agitation can be initiated either while the metallic composition is all liquid or when a small portion of the metal is solid, but containing less solid than that which promotes the formation of a solid dendritic network. Agitation can be initiated with cooling and continued or can be initiated after cooling is initiated. Solid particles comprising the third phase of the composition are added to the liquid-primary solid metallic composition after all or a portion of the primary solids have been formed and the third phase particles are dispersed within the metal composition such as by agitation. After the third phase particles have been dispersed in the metallic composition, the melt can be cast to a desired form, can be cooled to form a slug which can be formed or cast subsequently by heating and shaping; in which either case the final composition contains primary solids, or the temperature of the metallic composition can be increased to liquify the primary solids and then solidified in which case the final composition does not contain primary solids.

The metal matrix in the composition of this invention can be formed from a wide variety of metals or alloys which, when frozen from a liquid state without agitation form a dendritic structure. When the composition of this invention includes primary solid discrete particles, the composition contains a secondary phase which can be either solid or liquid and a solid third phase which third phase has a composition different from the primary solid particles and the secondary phase and which has a surface composition which is not wet by the metal matrix when it is liquid. The secondary phase is solid when the metal composition is solid and liquid when the metal composition is partially liquid. The primary particles comprise small degenerate dendrites or nodules which are generally spheroidal in shape and are formed as a result of agitating the melt when it contains solids and when the secondary phase is liquid. The primary solid particles are made up of a single phase or a plurality of phases having an average composition different from the average composition of the surrounding secondary phase, which secondary phase can itself comprise primary and secondary phases upon further solidification.

By the term "primary solid" as used herein is meant the phase or phases solidified to form discrete degenerate dendrite particles as the temperature of the melt is reduced below the liquidus temperature of the metal into the liquid-solid temperature range prior to casting the liquid-solid slurry form. By the term "secondary solid" as used herein is meant the phase or phases that solidify from the liquid existing in the slurry at a lower temperature than at which the primary solid particles are formed after agitation ceases and exclusive of the third phase. The primary solids obtained in the composition of this invention differ from normal solidified structures in that they comprise discrete particles suspended in the remaining liquid phase. Normally solidified alloys, in absence of agitation, have branched dendrites separated from each in the early stages of solidification, i.e. up to fifteen to 20 wt. percent solid, and develop into an interconnected network as the temperature is reduced and the weight fraction solid increases. The composition containing primary solids on the other hand prevents formation of the interconnected network by maintaining the discrete primary particles separated from each other by the liquid phase even up to solid fractions of about 65 weight percent. The primary solids are degenerate dendrites in that they are characterized by having smoother surfaces and less branched structures which approaches a spherical configuration than normal dendrites and may have a quasi-dendritic structure on their surfaces, but not to such an extent that interconnection of the primary particles is effected to form a network dendritic structure. The primary particles may or may not contain liquid entrapped within the particles during particle solidification depending upon severity of agitation and the period of time the particles are retained in the liquid-solid range. However, the weight fraction of the entrapped liquid is less than that existing in a normally solidified alloy at the same temperature employed in the present processes to obtain the same weight fraction solid.

This secondary solid which is formed during solidification from the liquid phase subsequent to forming the primary solid contains one or more phases of the type which would be obtained during solidification, exclusive of the third phase, by presently employed casting processes. That is, the secondary phase comprises solid solutions, or mixtures of dendrites, compounds and/or solid solutions.

The size of the primary particles depends upon the alloy or metal composition employed, the temperature of the solid-liquid mixture, the time the alloy spends in the solid-liquid temperature range, the degree of agitation employed with larger particles being formed at the lower temperature and when using less severe agitation. Thus, in general the size of the primary particles depends on composition and thermo-mechanical history of the slurry and can range from about 1 to about 10,000 microns. It is preferred that the composition contain between 10 and 50 weight percent primary solids since these compositions have a viscosity which promotes ease of casting or forming.

The compositions of this invention can be formed from any metal alloy system or pure metal regardless of its chemical composition which, when frozen from the liquid state without agitation forms a dendritic structure. Even though pure metals and eutectics melt at a single temperature, they can be employed to form the composition of this invention since they can exist in liquid-solid equilibrium at the melting point by controlling the net heat input or output to the melt so that, at the melting point, the pure metal or eutectic contains sufficient heat to fuse only a portion of the metal or eutectic liquid. This occurs since complete removal of heat of fusion in a slurry employed in the casting process of this invention cannot be obtained instantaneously due to the size of the casting normally used and the desired composition is obtained by equating the thermal energy supplied, for example by vigorous agitation, and that removed by a cooler surrounding environment. Representative suitable alloys include lead alloys, magnesium alloys, sinc alloys, aluminum alloys, copper alloys, iron alloys, nickel alloys, cobalt alloys. Examples of these alloys are lead-tin alloys, zinc-aluminum alloys, zinc-copper alloys, magnesium-aluminum alloys, magnesium-aluminum-zinc alloys, magnesium-zinc alloys, aluminum-copper alloys, aluminum-silicon alloys, aluminum-copper-zinc-magnesium alloys, copper-tin bronzes, brass, aluminum bronzes, steels, cast irons, tool steels, stainless steels, super-alloys, and cobalt-chromium alloys, or pure metals such as iron, copper or aluminum.

The third phase of the compositions of this invention is formed by the solid particles which are added to the primary solid-secondary liquid phase slurry. For purposes of this invention, the composition of the particles forming the third phase can include any solid or liquid composition which normally are added to metal alloy compositions to change one or more physical characteristics of the metal alloy composition and which has a surface composition which is not wet by the metal matrix when the matrix is liquid. Representative suitable examples of solid particles include graphite, metal carbides, sand, glass, ceramics, metal oxides such as thorium oxide, pure metals and alloys, etc. As employed herein, a composition that is not wet by the matrix refers to compositions which, when added to a metal or metal alloy at or slightly above the liquidus temperature of the metal or metal alloy and mixed therein, as by agiatation with rotating blades for a suitable period to effect intimate contact therewith, e.g. about 30 minutes, are not retained homogeneously in measurable concentrations within the liquid after agitation thereof has ceased and the resultant composition is allowed to return to a quiescent state when the metal or metal alloy is at or slightly above the liquidus temperature.

It has been found that compositions containing third phase particles can be formed having a greatly increased weight percentage of such particles as compared to compositions obtained by presently available processes. It is believed that the primary solid particles present in the slurry provide mechanical interaction with the newly added particles forming the third phase and prevent the third phase particles from floating up or sinking in the melt upon addition. Furthermore, the additional liquid-solid interfaces between the primary solids and the secondary phase liquid provide energetically favorable conditions for the new particles to become attached thereto and permit them to be retained. While applicants do not desire to be bound by a theory to explain the mechanism by which the third particles are retained, it is believed that the interaction of the secondary liquid in the metal and the third phase particles can occur by one or more of the following mechanisms: 1.) reaction and formation of a new phase at the metal-third phase particle interface, 2.) corrosion of the third phase particle and formation of a very fine interfacial layer, 3.) penetration of metal along grain boundaries of the third phase particle and 4.) formation of solid solutions by diffusion. The compositions that can be obtained in accordance with this invention contain these third phase particles homogeneously distributed within the basic metal alloy composition. Accordingly, this invention provides substantial advantages over the prior art in that the latitude available for changing the basic characteristics of metal alloy compositions is greatly widened and these characteristic changes can be effected homogeneously throughout the metal alloy composition.

This invention will be more fully described with reference to the accompanying drawings.

Figure 1:
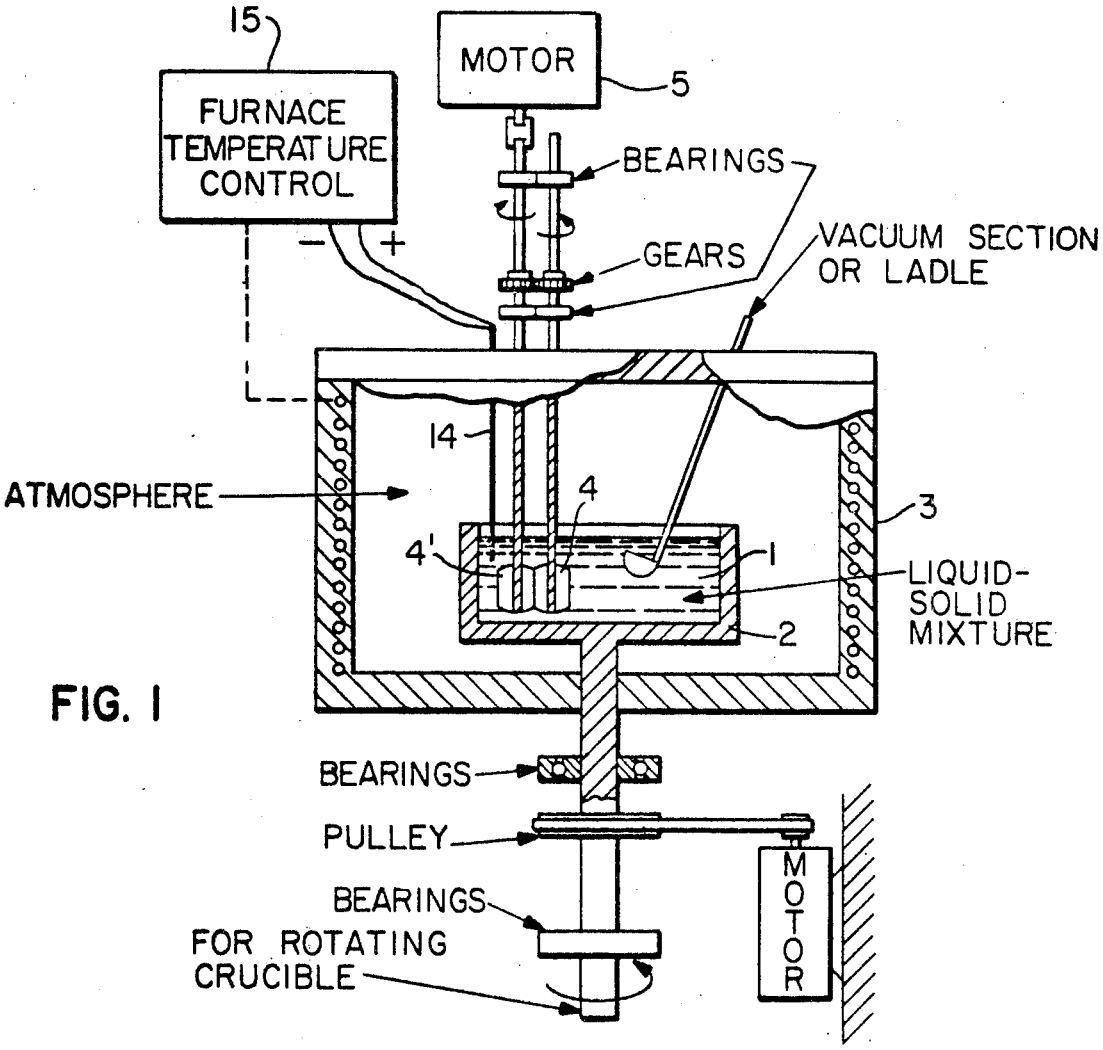
FIG. 1 is an elevation view, schematic in form and partially in cross section, of apparatus adapted to practice the method herein disclosed.

Referring to the figures, an apparatus for forming a liquid-solid mixture of metal alloys that solidify over a range of temperatures is shown at 1 in FIG. 1. Prior to adding the particles forming the third phase, the temperature of the metal in a crucible 2 within an electric furnace 3 is heated until all or a substantial portion of the melt 1 is in the liquid state. At this juncture counter-rotating blades 4 and 4' are introduced into the melt 1 and caused to rotate at from three hundred to five hundred RPM by an electric motor 5 to effect vigorous agitation of the melt 1. The crucible 2 is also caused to rotate (but at the reduced speed of five to 10 RPM) by motor 6. Temperature control of the furnace is accomplished by using a thermocouple 14 to provide inputs in a furnace control device represented by block 15. Thereafter the temperature of the melt is reduced to effect some solidification or to effect additional solidification if some solid already exists. It is to be understood the temperature reduction and vigorous agitation need not be coextensive. The melt can be first cooled to form a small weight percentage of solids and then it can be agitated to form the degenerate dendrites either with or without further cooling. The temperature can be reduced by employing the present teachings to obtain up to about sixty-five percent primary solids in the mixture. Thereafter, the particles forming the third phase are added to the liquid-solid mixture and the resultant composition then is agitated to obtain a relatively homogeneous distribution of third phase particles within the liquid metal. After mixing, for sufficient lengths of time for particle-liquid metal interaction to occur the composition can be cast employing the usual techniques or it can be reheated up to or above the liquidus temperature of the initial alloy composition while agitation continues and then cast employing the usual techniques.

Figure 2:
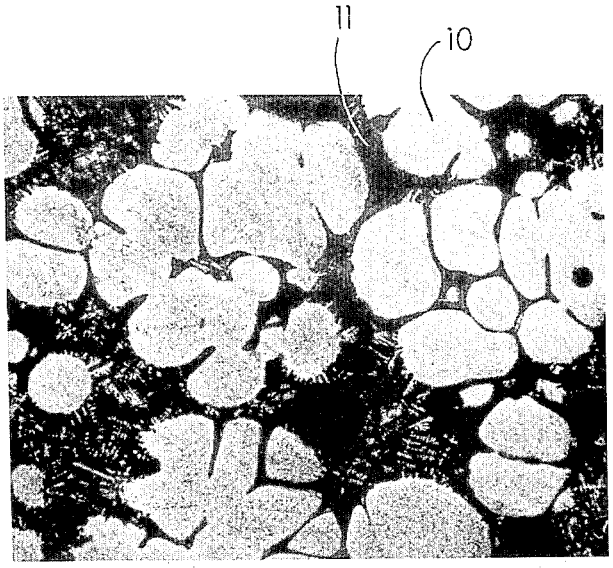
FIG. 2 is a reproduction of a photomicrograph showing the structure of an aluminum—4.1 percent silicon –1.8 percent iron casting made from the partially liquid-partially solid slurry state to which slurry third phase particles can be added by the present teachings.

FIG. 2 is a reproduction of a photomicrograph taken at 50 times magnification showing the structure of the casting made of an alloy of aluminum—4.14 percent silicon –1.8 percent iron which was agitated for about 30 minutes at a temperature of 613°C and poured when the liquid-solid mixture was about 40 to 45 percent primary solid. The casting comprises globular-type primary solid metal formations 10 and secondary solids 11.

Figure 3:
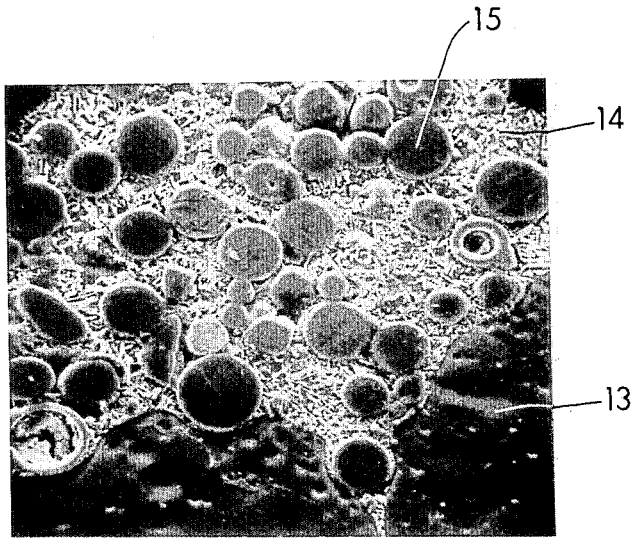
FIG. 3 is a reproduction of a picture made with a scanning electron microscope of a casting made with the alloy of FIG. 2 to which were added glass particles

FIG. 3 is a reproduction of a picture taken with a scanning electron microscope at 420 times magnification of an aluminum—4.14 percent silicon–1.8 percent iron alloy to which were added 20 weight percent of glass particles of 20–40 micron size. The glass particles were added to the alloy at 613°C after the alloy had been agitated to form a composition containing about 45 weight percent primary solids. The metal alloy-glass particle mixture was then agitated for about 30 minutes at 613°C to obtain a homogeneous distribution of the glass particles in the secondary liquid phase. As shown in FIG. 3, the casting obtained by solidifying the metal alloy-glass composition comprised primary solids 13, a secondary phase 14 and glass particles 15 homogeneously distributed within the secondary phase 14.

Figure 4:
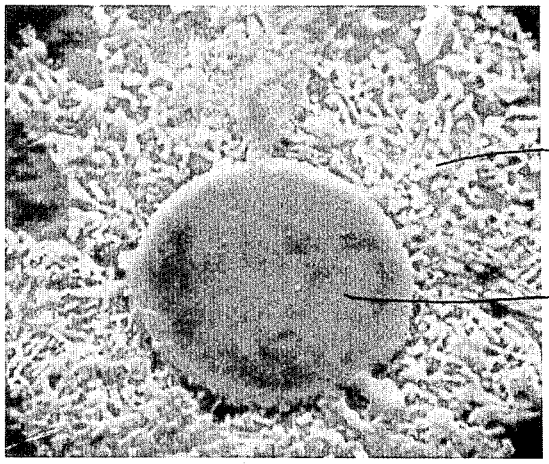
FIG. 4 is a reproduction of a picture made with a scanning electron microscope of a casting made with the alloy of FIG. 2 to which were added glass particles.

FIG. 4 is a reproduction of a picture taken with a scanning electron microscope taken at 1700 times magnification of an aluminum—4.14 percent silicon–1.8 percent iron alloy to which were added 20–40 micron size glass particles. The glass particles comprise 10 weight percent of the casting and were added to the alloy containing about 45 weight percent primary particles. After the glass particles were added, the resultant composition was agitated for about 30 minutes at 613°C to obtain a homogeneous distribution of the glass within the secondary phase. The casting obtained by solidifying the metal alloy glass-mixture comprises primary solids (not shown), glass particles 17 bound over their entire surfaces to the secondary phase 18.

Figure 5:
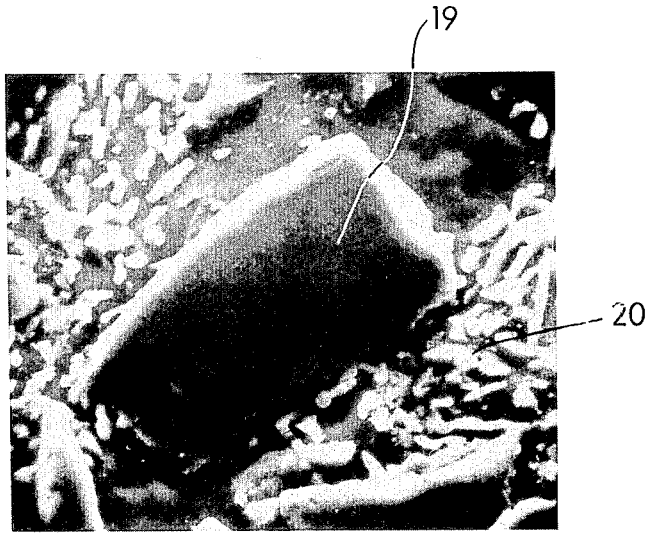
FIG. 5 is a reproduction of a picture made with a scanning electron microscope of a casting made with the alloy of FIG. 2 to which were added silicon carbide particles.

FIG. 5 is a reproduction of a photomicrograph taken at 1760 times magnification of an aluminum—4.14 percent silicon–1.8 percent iron alloy to which was added 44 micron average size silicon carbide particles. The silicon carbide particles comprise 20 weight percent of the casting and were added to the alloy maintained at a temperature of 613°C when the alloy contained about 45 weight percent primary solids. After the silicon carbide particles were added, the resultant composition was agitated for about 30 minutes at 613°C to obtain a homogeneous distribution of the silicon carbide within the secondary phase. The casting obtained by solidifying the metal alloy-silicon carbide mixture comprises primary solids (not shown) and silicon carbide particles 19 in intimate contact with the secondary phase 20.

Figure 6:
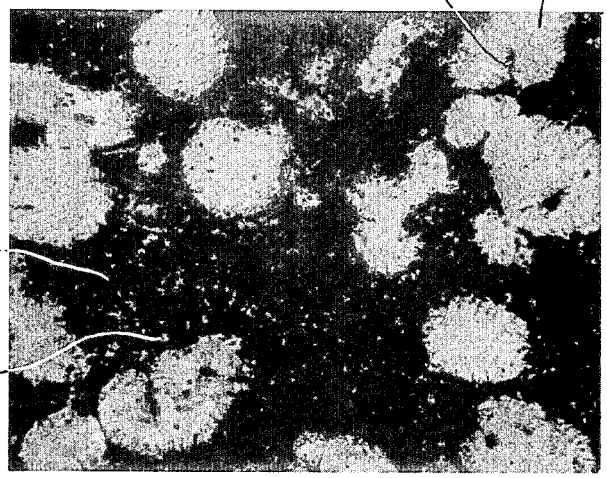
FIG. 6 is a reproduction of a photomicrograph showing the structure of the alloy of FIG. 2 to which were added silicon carbide particles.

FIG. 6 is a reproduction of a photomicrograph taken at 50 times magnification of the casting shown in FIG. 5. The silicon carbide particles comprise 20 weight percent of the casting and were added to the alloy maintained at a temperature of 613°C when the alloy contained about 45 weight percent primary solids. After the silicon carbide particles were added, the resultant composition was agitated for about 30 minutes at 613°C to obtain a homogeneous distribution of the silicon carbide within the secondary phase. The casting obtained by solidifying the metal alloy silicon carbide mixture comprises primary solids 21 which contained a solid 22 which is secondary phase liquid entrapped within the primary solids during their formation and silicon carbide particles 19 homogeneously distributed within the secondary phase 20.

Figure 7:
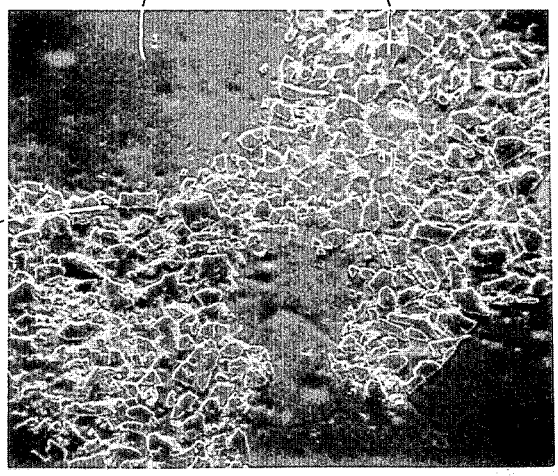
FIG. 7 is a reproduction of a picture made with a scanning electron microscope showing the alloy of FIG. 2 to which were added aluminum oxide particles.

FIG. 7 is a reproduction of a picture made with a scanning electron microscope at 190 times magnification of an aluminum—4.14 percent silicon –1.8 percent iron alloy to which was added 30 weight percent of 44 micron size aluminum oxide particles. The aluminum oxide particles were added to the alloy at 617°C after it was agitated for 30 minutes and it contained 40 weight percent primary solid. After the aluminum oxide particles were added, the resultant composition then was mixed for about 30 minutes prior to casting it. The casting obtained by solidifying the metal alloy-aluminum oxide mixture comprised primary solids 23 and a secondary phase 24 within which was homogeneously dispersed aluminum oxide particles 25.

Figure 8:
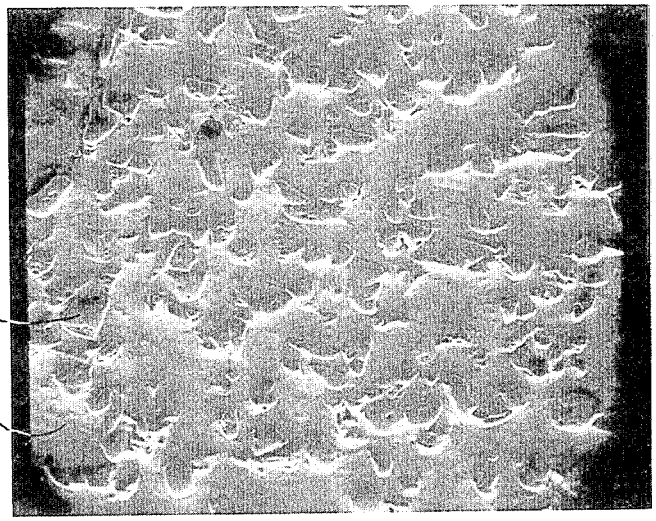
FIG. 8 is a reproduction of a picture made with a scanning electron microscope showing the structure of a casting formed from the alloy of FIG. 2 containing no primary particles and to which were added aluminum oxide particles.

FIG. 8 is a reproduction of a picture taken with a scanning electron microscope at 205 magnification of an aluminum-4.14 percent silicon–1.8 percent iron alloy to which was added 10 weight percent of 44 micron size aluminum oxide particles. The aluminum oxide particles were added to the alloy at 617°C after it was agitated for 30 minutes and it contained 40 weight percent primary solid. After the aluminum oxide particles were added, the resultant composition was mixed for an additional 30 minutes. Subsequently the temperature of the metal alloy oxide composite was raised to the liquidus temperature of the alloy, 635°C, while agitation was continued. With increasing temperature from 617°C the primary solid particles existing in the slurry were gradually remelted, thus decreasing their weight fraction from 40 to 0 weight percent. The liquid alloy now in a completely molten state and containing 10 weight percent of retained aluminum particles were cast. The casting obtained by solidifying the metal alloy-aluminum oxide mixture comprises homogeneously dispersed aluminum oxide particles 26 in an otherwise normally solidified alloy matrix 27.

Figure 9:
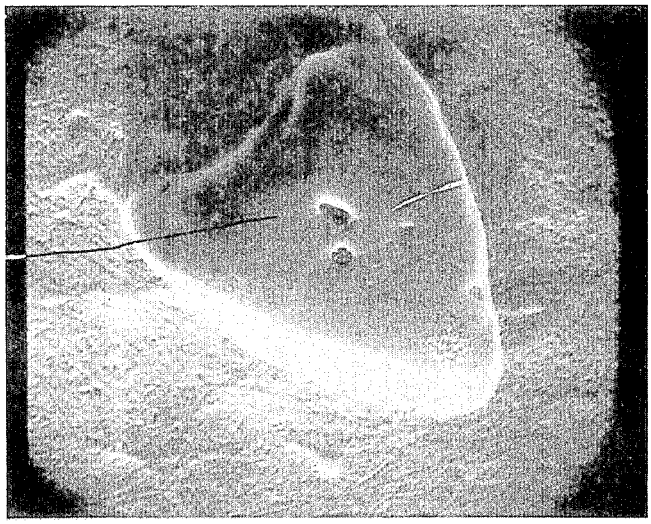
FIG. 9 is a reproduction of a picture made with a scanning electron microscope of a casting of the composition of FIG. 8.

FIG. 9 is a reproduction of a picture taken with a scanning electron microscope at 2050 magnification of the composition shown in FIG. 8. As shown, the interface between the aluminum oxide particle 26 and the alloy 27 is hole-free.

Figure 10:
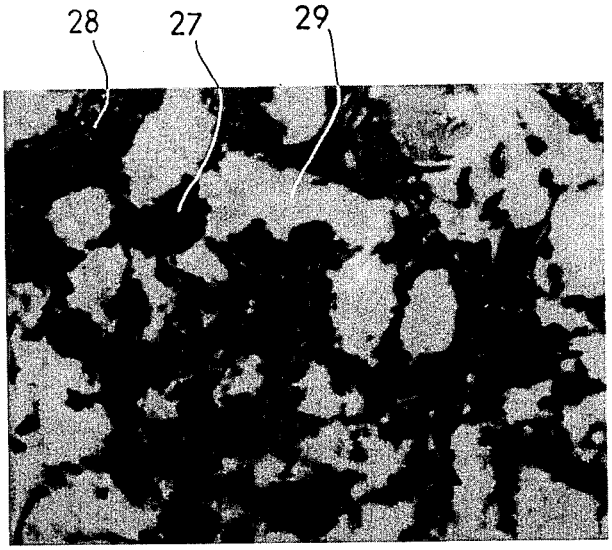
FIG. 10 is a reproduction of a photomicrograph showing the structure of a casting having the same compositions as that of FIG. 2 to which were added titanium carbide particles.

FIG. 10 is a reproduction of a photomicrograph taken at 500 times magnification of an aluminum—4.14 percent silicon–1.8 percent iron alloy to which was added 1 to 5 micron size titanium carbide particles. The titanium carbide particles were added to the alloy when it was at a temperature of 613°C and after it was agitated for 30 minutes to form 45 weight percent primary solids therein. The casting obtained by solidifying the metal alloy-titanium carbide mixture comprised 3 weight percent titanium carbide particles 27 homogeneously dispersed within the secondary phase 28 as well as primary solids 29.

The weight percent of particles forming the third phase particles that can be added to a metal alloy can be varied widely. Higher weight percent of third phase particles can be added when the weight percentage of primary solids is relatively low or when addition of the third phase particles is accompanied by reheating of the melt thus reducing the weight percent of the primary solid particles already existing in the melt. The third phase particles added to such a mixture become distributed within the secondary phase liquid and since there is more secondary phase liquid present, more third phase particles can be added. However, the primary particles should not be so small or widely distributed in the secondary phase as to present substantially no interaction with the third phase particles added. Generally, the primary particles should be present in the alloy in amounts of at least 5 weight percent and can vary up to about 65 weight percent. Furthermore, when it is desired to homogeneously distribute the third phase particles throughout the metal matrix, irrespective of the weight percent of third phase added, after the third phase particles are sufficiently dispersed into the secondary liquid phase, the slurry is heated, while agitation continues, to or above the liquidus temperature of metal alloy composition, remelting all the primary solid particles and casting the resulting composition of completely molten metal with homogeneous distribution of third phase particles. When it is desired to add large amounts of third phase particles, it is preferred to add them in a manner wherein the first addition is conducted when the metal alloy composition contains a relatively high weight percent of primary particles, and subsequently heating the metal alloy composition-particle mixture to reduce the weight percent of primary particles, thereby forming more secondary phase liquid and permitting the mixture of additional third phase particles. During this procedure, the third phase particles are added and the resultant composition agitated to attain the desirable wetting and interaction of the third phase particles with the metal matrix. The composition then is further heated to reduce the concentration of primary particles thereby forming more secondary phase liquid and permitting the addition of more third phase particles. Furthermore, additional liquid secondary phase can be obtained without heating by adding a component of the original alloy to change the alloy composition so that the temperature at which the new alloy becomes a liquid-solid mixture is less than that of the original alloy.

In one aspect of our invention, the process for adding third phase particles by a sequence of particle addition steps is applicable to third phase particles that are wet by the liquid portion of the metal alloy matrix to which they are added as well as third phase particles that are not wet by the liquid metal alloy matrix. As used herein, wet particles are those particles which when added to the metal matrix and the resultant mixture is agitated as with rotating blades for a suitable period of time to effect intimate contact therewith, e.g. about 30 minutes and subsequently allowed to return to a quiescent state are retained in the liquid metal matrix in measurable concentrations. The wet particles are retained therein in concentrations from a measurable concentration of slightly above 0% by weight, and generally up to about 5% by weight. In some cases, the concentration of wet particles can be up to about 40% by weight. Representative examples of wetting comprises a system including nickel-coated graphite in aluminum alloys as disclosed by U.S. Pat. No. 3,600,163 or tungsten carbide in aluminum, magnesium or zinc as disclosed by U.S. Pat. No. 3,583,471. These patents are incorporated herein by reference.

In each particle addition step, the particles are added up to the capacity for the secondary phase to retain them and/or up to a weight fraction where the total weight fraction of primary particles and third phase particles does not exceed 65 percent. This capacity of retention of the third phase particles by the secondary phase is exceeded when the particles are observed to begin floating to the melt surface or sinking to the bottom of the melt. On the other hand, when the total weight percent of the primary solid particles and third phase particles exceeds 65 percent the slurry viscosity increases and it behaves like a solid. The formation of additional liquid subsequent to the third phase particle addition does not effect the removal of the previously added third phase particles since they have had time to become wet by the secondary liquid phase and/or to interact with the primary particles present therein so that they are retained in the metal composition. This result is obtained even when the composition is heated to or above the liquidus temperatures of the metal composition. By operating in this manner, it is possible to attain up to about 65 weight percent third phase particle addition into the metal alloy. The preferred concentration of third phase particles depends upon the characteristics desired for the final metal composition and thus depends upon the metal alloy and particle compositions. The third phase particles are of a size which promotes their admixture to form homogeneous compositions and prefereably of a size of between 1/100 and 10,000 microns. It has been found that when third phase particles having a harder surface than the primary solid particles are added to the metal alloy composition, the size of the primary particles can be reduced during vigorous agitation by mechanical interaction with the harder third phase particles.

It is desirable to attain uniform distribution of the third phase particles which can be controlled by increasing the degree and duration of mixing, employing relatively low rates of addition of the third phase particles and by controlling the weight percent of third phase particles added to the metal for a given weight of primary solids in the metal.

When the desired composition has been formed, which in the first case can consist of primary solid-secondary liquidthird phase addition or in the second case, just reheated, completely molten, liquid metal with third phase addition, it can be cooled to form a solid slug or ingot for easy storage. Later the slug or ingot can be heated to a temperature wherein a primary solid-secondary liquid-third phase mixture is attained in the first case mentioned above, or to a temperature where the alloy is completely molten with the still homogeneously distributed third phase particles in the second case mentioned above, and recast using the usual techniques. Furthermore, a slug prepared according to the first case procedure just outlined possesses thixotropic properties when reheated to the liquidsolid state. It can, thus be fed into a modified die casting machine or other apparatus in apparently solid form. However, shearing resulting when this apparently solid slug is forced into a die cavity causes the slug to transform to a metal alloy whose properties are more nearly that of a liquid thereby permitting it to be shaped in conformance to the die cavity.

Alternatively, casting can be effected directly after the third phase particles have been successfully added to the primary solid-liquid mixture or the reheated lower weight percent primary solid or completely melted alloy-third phase particles mixture by pouring, injection or other means. The process disclosed is useful for die casting, permanent mold casting, continuous casting, closed die forging, hot pressing, vacuum forming and other forming processes. The effective viscosity of the compositions therein and the high viscosity that can be obtained with the compositions of this invention result in less metal spraying in their entrapment in die casting and permits higher metal entrance velocities in this casting process. Furthermore, more uniform strength and more dense castings result from the present method.

Vigorous agitation can be effected, with counter rotating blades, electromagnetic stirring, gas bubbling with relatively large bubbles not retained in the metal, or other agitationinducing mechanisms. The agitation is sufficient to prevent the formation of interconnected dendritic networks or to substantially eliminate or reduce dendritic branches already formed on the primary solid particles.

We claim:

1. The method for forming a metal composition comprising a metal alloy matrix and solid particles homogeneously suspended in said matrix, said solid particles having a composition different from said alloy and having a surface composition that is not wet by the metal alloy when said metal alloy is liquid which comprises a. heating a metal alloy to form a liquid-solid mixture of said alloy wherein less than about 65 weight percent thereof is solid, b. vigorously agitating said liquid-solid mixture to convert the solid therein to discrete degenerate dendrites derived from said metal alloy, said degenerate dendrites comprising up to about 65 weight percent of the heated metal alloy and wherein the remainder of the heated metal alloy is liquid, c. adding said solid particles to said heated metal alloy containing said degenerate dendrites and d. dispersing said solid particles homogeneously in said heated metal alloy containing degenerate dendrites, said solid particles being added in an amount up to about 65 weight percent based upon the weight of metal alloy and degenerate dendrites.

2. The method for forming a metal composition comprising a metal alloy matrix and solid particles homogeneously suspended in said matrix, said solid particles having a composition different from said alloy and having a surface composition that is not wet by the metal alloy when said metal alloy is liquid which comprises a. heating a metal alloy to form a liquid-solid mixture of said alloy wherein less than about 65 weight percent thereof is solid, b. vigorously agitating said liquid-solid mixture to convert the solid therein to discrete degenerate dendrites derived from said metal alloy, said degenerate dendrites comprising up to about 65 weight percent of the heated metal alloy and wherein the remainder of the heated metal alloy is liquid, c. adding said solid particles to said heated metal alloy containing said degenerate dendrites, d. dispersing said solid particles homogeneously in said heated metal alloy containing degenerate dendrites, e. heating the metal alloy containing said solid particles to liquify an increased amount of said metal alloy, f. adding an additional amount of said solid particles to the composition produced from step (e) and g. dispersing said additional amount of solid particles homogeneously in said metal alloy, the total of said solid particles comprising up to about 65 weight percent of said metal composition.

3. The method of claim 1 wherein the liquid-solid mixture is cooled concomitant with said vigorous agitation to increase the concentration of said degenerate dendrites prior adding said solid particles.

4. The method of claim 3 wherein the liquid-solid mixture is cooled to form between 10 and 50 weight percent degenerate dendrites prior to adding said solid particles.

5. The method of claim 1 wherein said liquid-solid mixture is cooled to form a solid having said degenerate dendrites homogeneously distributed therein after said solid particles have been dispersed in said metal alloy.

6. The method of claim 3 wherein said liquid-solid mixture is cooled to form a solid having said degenerate dendrites and said solid particles homogeneously distributed therein after said solid particles have been dispersed in said metal alloy.

7. The method of claim 4 wherein said liquid-solid mixture is cooled to form a solid having said degenerate dendrites and said solid particles homogeneously distributed therein after said solid particles have been dispersed in said metal alloy.

8. The method of claim 5 wherein said solid is heated to a temperature at which the solid is thixotropic and applying a force to the thixotropic solid thereby transforming it into a material having properties more nearly that of a liquid to cast said material.

9. The method of claim 6 wherein said solid is heated to a temperature at which the solid is thixotropic and applying a force to the thixotropic solid thereby transforming it into a material having properties more nearly that of a liquid to cast said material.

10. The method of claim 7 wherein said solid is heated to a temperature at which the solid is thixotropic and applying a force to the thixotropic solid thereby transforming it into a material having properties more nearly that of a liquid to cast said material.

11. The method of claim 2 wherein the heating to form increased liquid followed by adding and dispersing additional solid particles is continued until the degenerate dendrites are liquified.

12. The method of claim 2 which includes the further step of casting the metal composition comprising degenerate dendrites liquid and solid particles.

13. The method of claim 11 which includes the further step of casting the metal composition comprising the liquid having the initial composition of the alloy and the solid particles.

14. The method of claim 12 wherein the composition containing liquid is solidified and then heated prior to being cast.

15. The method of claim 13 wherein the composition containing liquid is solidified and then heated prior to being cast.

* * * * *